US008414243B2

(12) United States Patent
Stokes

(10) Patent No.: US 8,414,243 B2
(45) Date of Patent: Apr. 9, 2013

(54) VERTICAL PARKING LIFT SYSTEM

(76) Inventor: Van Stokes, Nutley, NJ (US)

( * ) Notice: Subject to any disclaimer, the term of this patent is extended or adjusted under 35 U.S.C. 154(b) by 93 days.

(21) Appl. No.: 12/765,026

(22) Filed: Apr. 22, 2010

(65) Prior Publication Data

US 2010/0272545 A1 Oct. 28, 2010

Related U.S. Application Data

(60) Provisional application No. 61/171,622, filed on Apr. 22, 2009.

(51) Int. Cl.
*E04H 6/18* (2006.01)

(52) U.S. Cl. ..... 414/228; 414/240; 187/213

(58) Field of Classification Search ..... 414/228, 414/233, 234, 239, 240; 187/213, 216, 221
See application file for complete search history.

(56) References Cited

U.S. PATENT DOCUMENTS

| | | | | |
|---|---|---|---|---|
| 4,668,142 | A * | 5/1987 | Fity et al. | 410/26 |
| 4,674,938 | A | 6/1987 | Stokes et al. | |
| 5,035,562 | A * | 7/1991 | Rosen | 414/240 |
| 5,207,333 | A * | 5/1993 | Peng | 211/85.8 |
| 5,727,656 | A * | 3/1998 | Gaudioso et al. | 187/221 |
| 5,743,696 | A * | 4/1998 | Rossato | 414/228 |
| 2009/0087290 | A1 * | 4/2009 | Wastel | 414/240 |

* cited by examiner

*Primary Examiner* — Jonathan Snelting

(74) *Attorney, Agent, or Firm* — Timothy X. Gibson, Esq.; Gibson & Dernier LLP

(57) ABSTRACT

An improved multilevel parking system includes platforms having an angled cross section member disposed at an end thereof, which facilitates close nesting of, and lateral support for, the platforms. A drive-on ramp may be attached to a lower-most platform, facilitating movement of vehicles onto the platforms.

9 Claims, 9 Drawing Sheets

VERTICAL PARKING LIFT SYSTEM

CROSS-REFERENCE TO RELATED APPLICATIONS

This application claims the benefit of U.S. Provisional Patent Application No. 61/171,622, filed Apr. 22, 2009 the entirety of which is incorporated herein by reference.

FIELD OF THE INVENTION

The present invention relates to vertical parking lift systems having multiple platforms and in particular to an improved vertical parking lift systems including close-nesting platforms for parking motor vehicles.

BACKGROUND OF THE INVENTION

Multi-level parking systems for automobiles, trucks, etc., have been used for many years. In many locations, single level parking is not cost effective. The most cost effective multi-level parking systems employ parking platforms that move vertically from the loading/unloading area to storage areas located above to save footprint space. Two level parking systems are used where height restrictions are in effect but in areas where there are no height restrictions three or more level systems are utilized.

When multi-level parking systems with three or more levels are used, they are usually built with platforms that stack on top of each other at the lowest level. When the platforms of the prior art are stacked in the lower-most position, the cumulative thickness of the stacked platforms presents an obstacle to driving a vehicle both on and off the top-most platform. The increased height of the stacked platforms prevents vehicles lacking sufficient ground clearance from being driven on or off the platforms. Various types of ramp systems have been used, which include ramps that are progressively longer as the stack incorporates additional levels.

In the more modern equipment, the platforms are designed to nest together at the lower positions. This reduces the height of the platform stack, which allows the vehicles to be driven on and off more easily. With that design, the rise and fall of the ramp is used as a structural cross member to stiffen the platform laterally. A consequence is that, when lowered, each platform and its associated ramp must lie on top on the platform below. For example, see U.S. Pat. No. 4,674,938 for a vertical parking system.

The problem with this platform nesting and stacking system is that the ramps must have a gradual rise and fall so the vehicles can be driven on and off the platforms easily. When the ramps are made with more gradual inclines for easier loading and unloading, the construction is typically thicker to maintain the required section laterally across the platform. Because each platform must have a ramp to maintain lateral strength this increase in ramp thickness creates a heavier and more costly set of platforms. Therefore, there is a need for a lightweight, sufficiently strong drive-on ramp system.

SUMMARY OF THE INVENTION

In view of the foregoing, various embodiments disclosed herein provide a drive-on ramp system including an angled cross section member mounted to an end of the platform which is lightweight yet has improved lateral support.

An aspect of the present disclosure provides a simple, lightweight drive-on ramp system having a plurality of platforms vertically arranged or stacked and a ramp operable to be employed with the plurality of platforms. In accordance with one or more aspects, the improved drive-on ramp system includes platforms having an angled cross section member disposed at an end thereof. The angled cross section members provide greater lateral support and therefore permit the platforms to be formed in a thinner construction. A single ramp can be disposed on the ground in front of the entrance end of a platform stack. The platforms, platform ends and drive-on ramp may comprise any material suitably strong to support vehicles to be stacked and stored, preferably a metal material and more preferably corrosion-resistant steel.

In a preferred embodiment, a drive-on ramp is connected to the lower-most platform. In this embodiment, the ramp can be raised off the lower level whenever the lower-most platform is moved to a raised position. This allows the ground level to be clear of obstructions when all the platforms are in the raised position. When all the platforms are disposed in the lowest position, the angled cross sections of the respective platforms nest together. As a result, a single ramp disposed in front of the stacked nested platforms is operable to permit a vehicle to mount the top-most platform. The top-most platform may be raised and another vehicle can be mounted on the next top-most platform. The last or the lower-most platform having the ramp disposed on or proximal the entrance end can then be raised.

Additionally, one of ordinary skill in the art will appreciate that drive-on ramps having different inclination angles may be employed so, for one advantage, a ramp having a suitable inclination angle may be used for a particular vehicle or other application. The ramp may be optionally hingedly-fixed to the entrance end of the lower-most platform in conjunction with or separately from embodiments comprising the other features recited herein. The drive-on ramp may also be formed such that a small gap between the top of the ramp and the top of the angled cross section members exists, which is of no consequence to the wheels of the vehicles.

Finally, it will be apparent to those of ordinary skill in the art that the present invention can be scaled to accommodate smaller, lighter vehicles having smaller wheels, for example a golf-cart or ride-on lawnmower to heavier vehicles, such as automobiles or larger trucks and SUVs.

Given above is a simplified summary of the claimed subject matter in order to provide a basic understanding of some aspects described herein. This summary is not an extensive overview, and is not intended to identify key/critical elements or to delineate the scope of the claimed subject matter.

BRIEF DESCRIPTION OF THE DRAWINGS

To assist those of ordinary skill in the relevant art in making and using the subject matter hereof, reference is made to the appended drawings, wherein.

Figure 1:
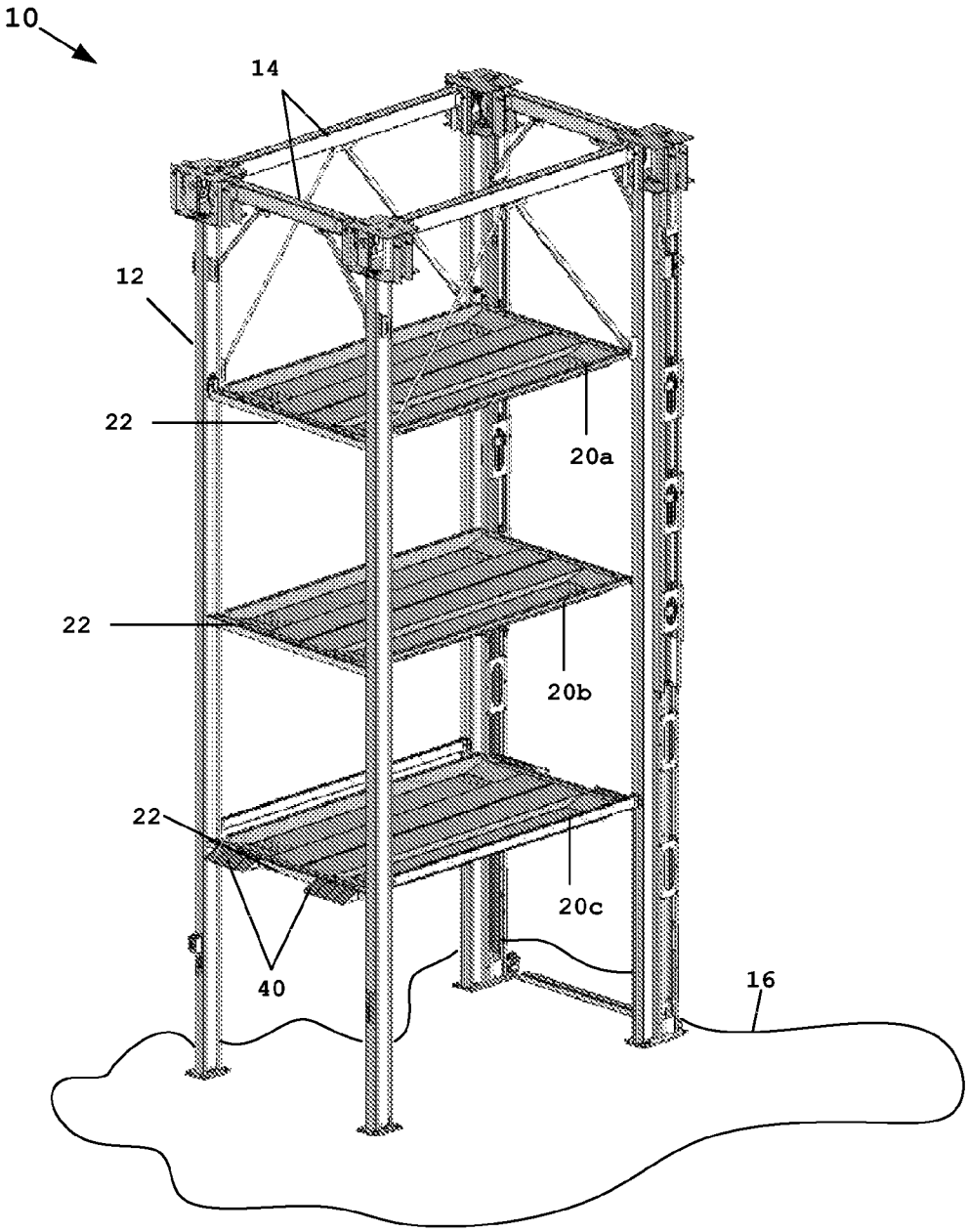
FIG. 1 depicts a perspective view of a multilevel parking system with platforms in a fully raised position.

It should be noted that the appended drawings illustrate only typical embodiments of this invention and are therefore not to be construed as limiting of its scope, for the invention may admit to other equally effective embodiments. Where possible, identical reference numerals have been inserted in the figures to denote identical elements.

DETAILED DESCRIPTION OF THE INVENTION

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

In the following description, for purposes of explanation, specific numbers, materials and configurations are set forth in order to provide a thorough understanding of the invention. It will be apparent, however, to one having ordinary skill in the art that the invention may be practiced without these specific details. In some instances, well-known features may be omitted or simplified so as not to obscure the present invention. Furthermore, reference in the specification to phrases such as "one embodiment" or "an embodiment" means that a particular feature, structure or characteristic described in connection with the embodiment is included in at least one embodiment of the invention. The appearances of phrases such as "in one embodiment" in various places in the specification are not necessarily all referring to the same embodiment.

Figure 2:
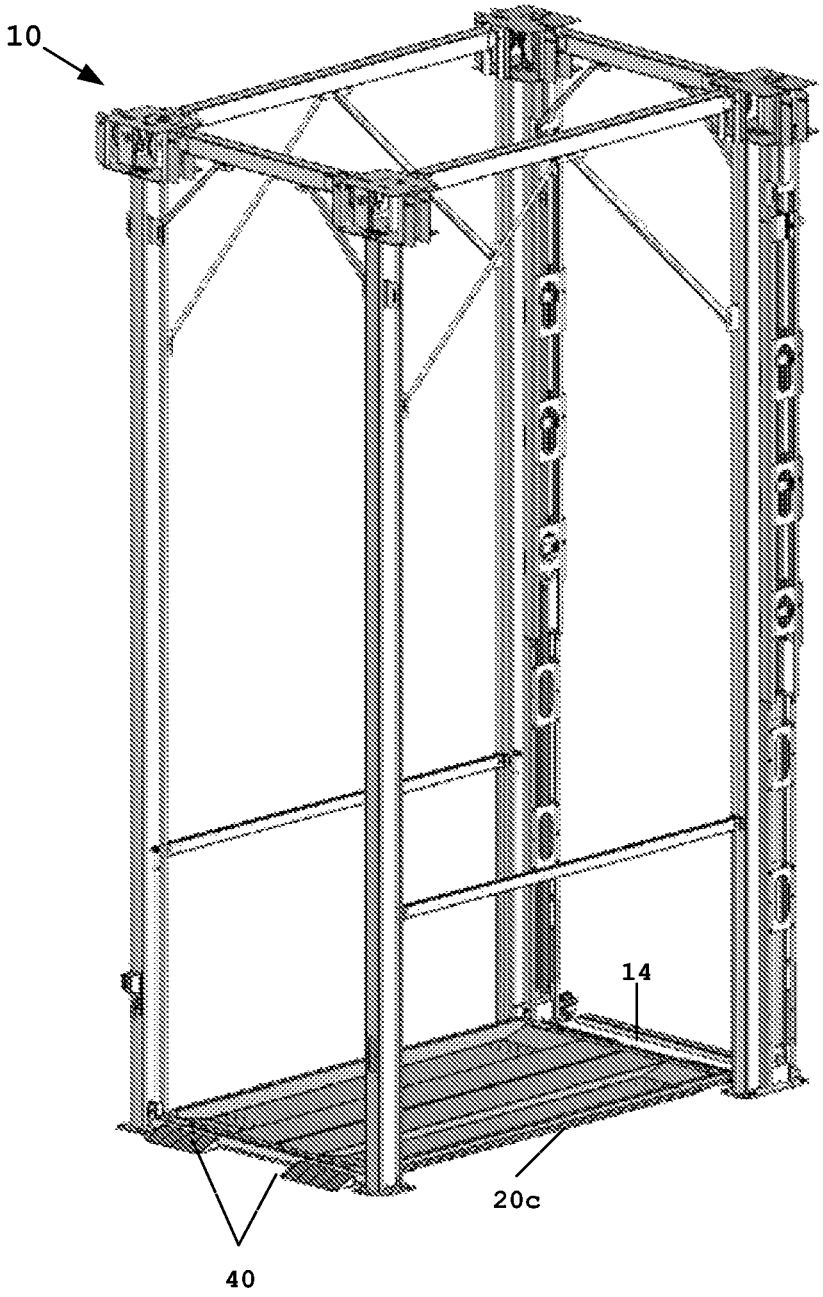
FIG. 2 depicts a perspective view of a multilevel parking system with platforms in a fully lowered position.

Turning now to the details of the drawings, FIG. 1 depicts multilevel parking system 10 in accordance with one aspect. The multilevel parking system 10 has a structure comprising upright frame members 12, cross members 14 and a plurality of platforms 20*a*, 20*b*, and 20*c* disposed in the frame and a ramp 40. The platforms 20*a*, 20*b* and 20*c* are disposed in a stacked orientation and movable upwards and downwards and adapted to be nested together in a lowered position, as shown in FIG. 2. The parking system 10 may be placed on any suitable base such as the ground, a footing, a floor or the like. It may be noted that three platforms are shown by the way of illustration and not limitation and that the parking system 10 may have a greater or lesser number of platforms. The platforms are adapted to be moved upward for supporting vehicles above the ground. A lifting mechanism as is well known in the art (not shown), such as a hydraulic or motorized or mechanical lift system, is provided for lifting the platforms 20*a*, 20*b*, and 20*c* with vehicles thereon. The multilevel parking system 10 as shown in FIG. 1 is in the fully raised position, with platforms 20*a*, 20*b*, and 20*c* at the positions that they would be in if disposed to handle four vehicles—one on each platform and one on the ground level 16, under platform 20*c*.

FIG. 2 depicts a perspective view of multilevel parking system 10 in the fully lowered position with drive-on ramps 40 connected to the entrance end 22 of platform 20*c*. In this embodiment, the platforms 20*a*-20*c* are in a lowered position wherein platform 20*c* is supported by the ground level 16 and platforms 20*b*, 20*a* are nested and supported by platform 20*c*. In an aspect, platform 20*a* may be tilted relative to platform 20*b* (not shown) in order to facilitate a vehicle to be driven onto the platform 20*a* via the entrance thereof. Mechanisms for tilting a parking platform are well-known in the art and include hydraulic and mechanical tilting mechanisms.

Figure 3A:
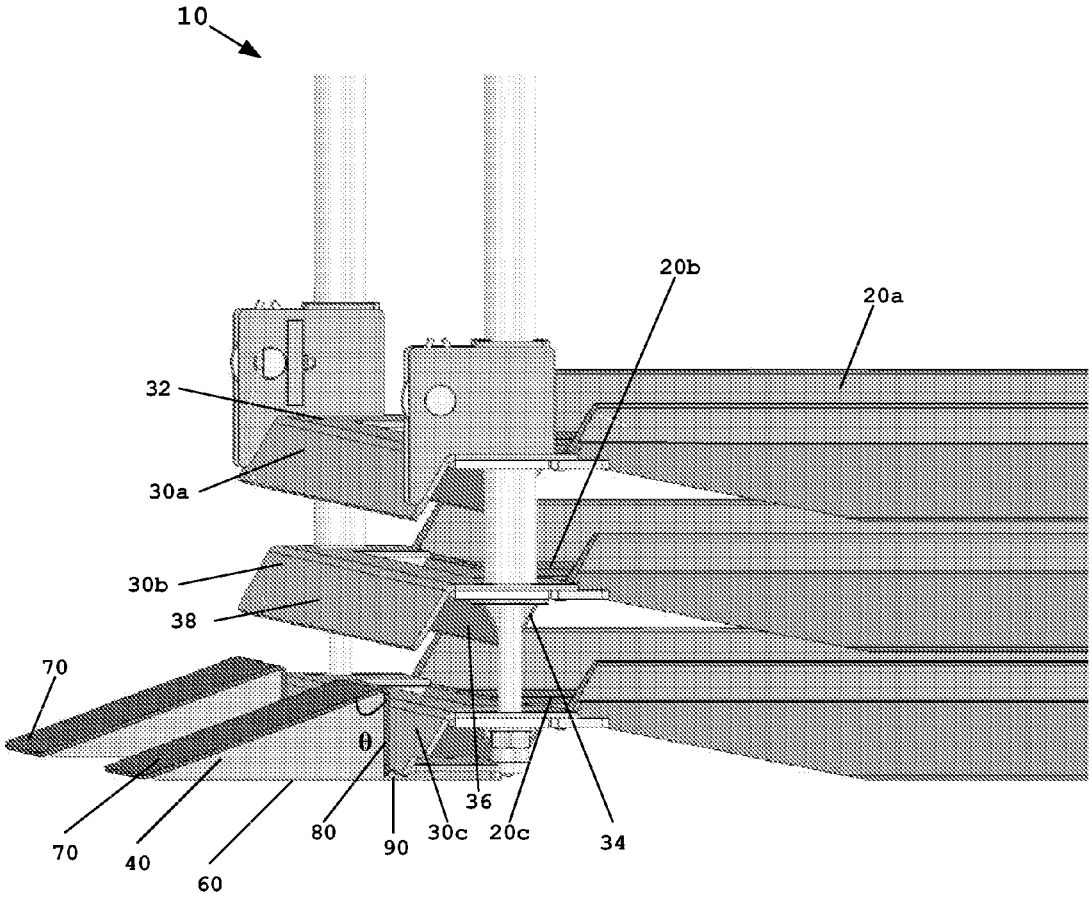
FIG. 3*a* depicts an illustration showing a perspective view of angled cross section members of the platforms in a partially nested configuration in accordance with one aspect.
Figure 3B:
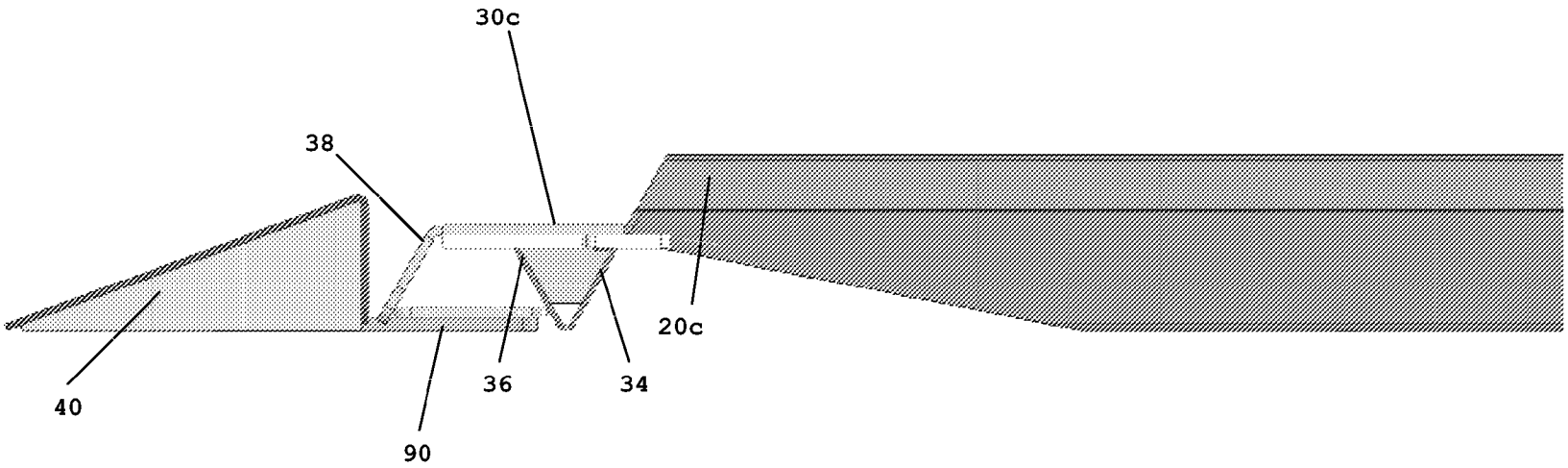
FIG. 3*b* depicts a side view of a platform with an angled cross section member in accordance with one aspect.

Now referring to FIGS. 3*a* and 3*b*, platforms 20*a*, 20*b*, and 20*c* include angled cross-section members 30*a*, 30*b*, 30*c*, respectively. Each angled cross-section member 30*a*-30*c* essentially comprises a planar member 32 with a first end extending from an entrance end 22 of the respective platform, the planar member 32 having disposed in a central portion thereof a downwardly angled portion 34 and an upwardly angled portion 36, forming a V-shaped angle with the bottom of the V extending downward. Extending from a second end of the planar member is a lip 38. The angled cross section members 30*a*-30*c* permit the respective platforms 20*a*, 20*b*, 20*c* to nest more closely than prior art platforms. Portions 34 and 36 formed in the planar member 32 increase the cross section of the platform and stiffen the platform laterally while allowing use of lighter, thinner materials. This allows for relatively thin, lighter platforms 20*a*-*c* as compared to the prior art.

Figure 4:
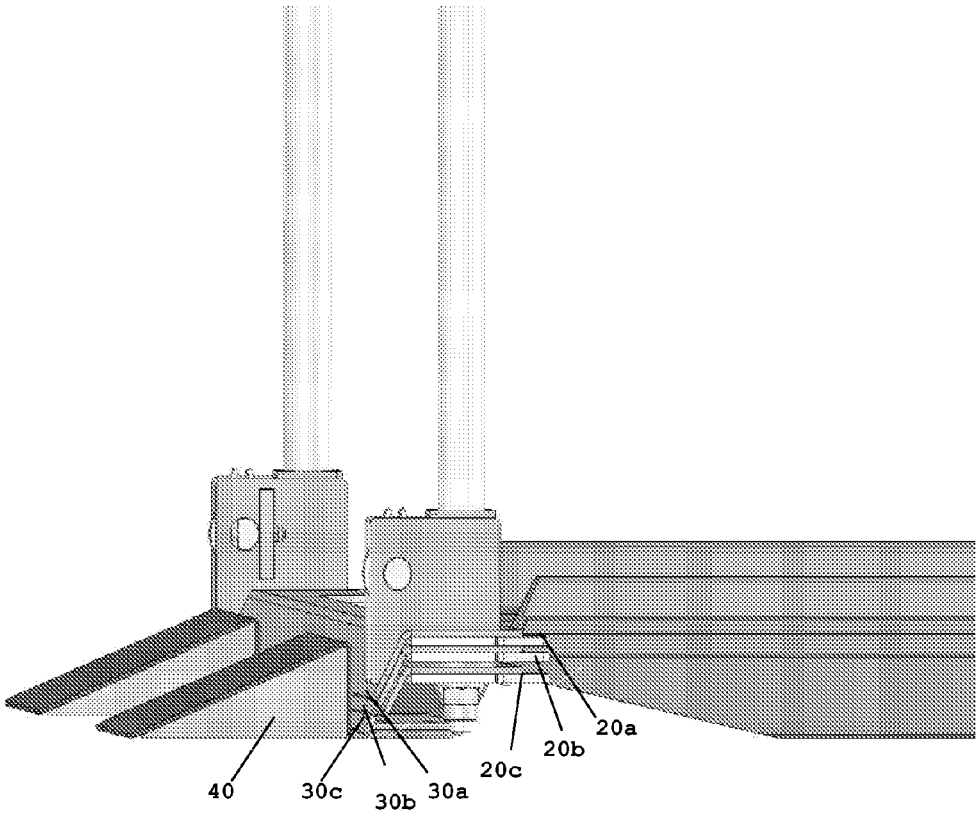
FIG. 4 depicts a perspective view of the angled cross section members illustrating the completed nesting effect of the platforms when at the lowest level in accordance with one aspect of the present invention.

Now referring to FIG. 4, the angled cross section members 30*a*, 30*b* and 30*c* are fully nested while in the fully lowered position. Because the angled cross section members 30*a*, 30*b* and 30*c* are nested, they meet and their aggregate thickness supports the weight of the vehicle that travels on them.

Referring again to FIG. 3*a*, ramp 40 essentially comprises a structure with a generally triangular cross-section with a lower horizontal surface 60, a first inclined surface 70, and a rear surface 80. While the surface 80 is shown to be a vertical surface forming an angle of 90° with the lower horizontal surface 60, this is merely exemplary. The drive-on ramp 40 can also be configured such that both the surfaces 70 and 80 are inclined at suitable angles (less than 90°) relative to the horizontal surface 60. One of ordinary skill in the art will appreciate that the drive-on ramp 40 may be formed at different inclination angles so that it is suitable to a particular vehicle, vehicle type, platform structure or other application. Thus, the drive-on ramp 40 as disclosed in accordance with different aspects described herein can be scaled to accommodate smaller, lighter vehicles having smaller wheels, for example a motorcycle, golf-cart or ride-on lawnmower to heavier vehicles, such as automobiles or larger trucks and SUVs (Sports Utility Vehicles). Further, in accordance with different embodiments, the drive-on ramp 40 can comprise a plurality of separate sections placed along the entrance end of the parking platform 20*c* as shown in FIG. 1, or it may be a single wide ramp disposed along the entrance end having sufficient width to receive both front and rear tires of a vehicle.

Figure 3C:
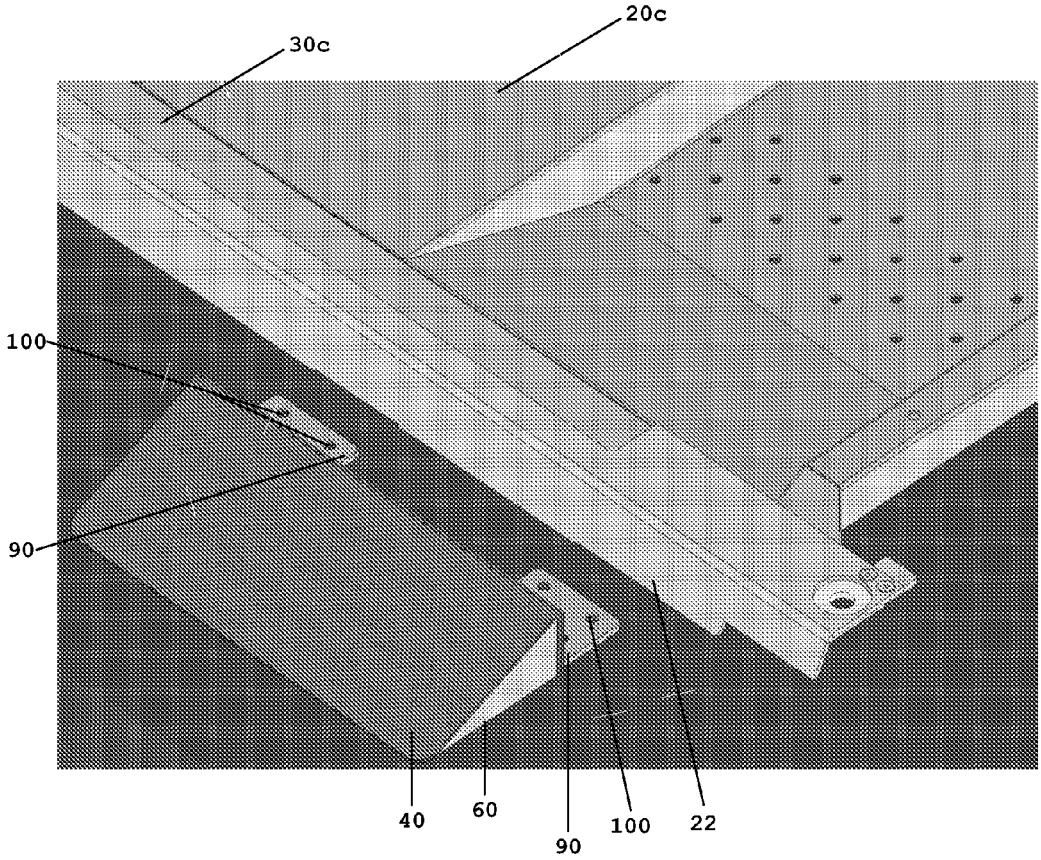
FIG. 3*c* depicts a perspective view of a drive-on ramp to be attached to a parking platform in accordance with an embodiment.
Figure 3D:
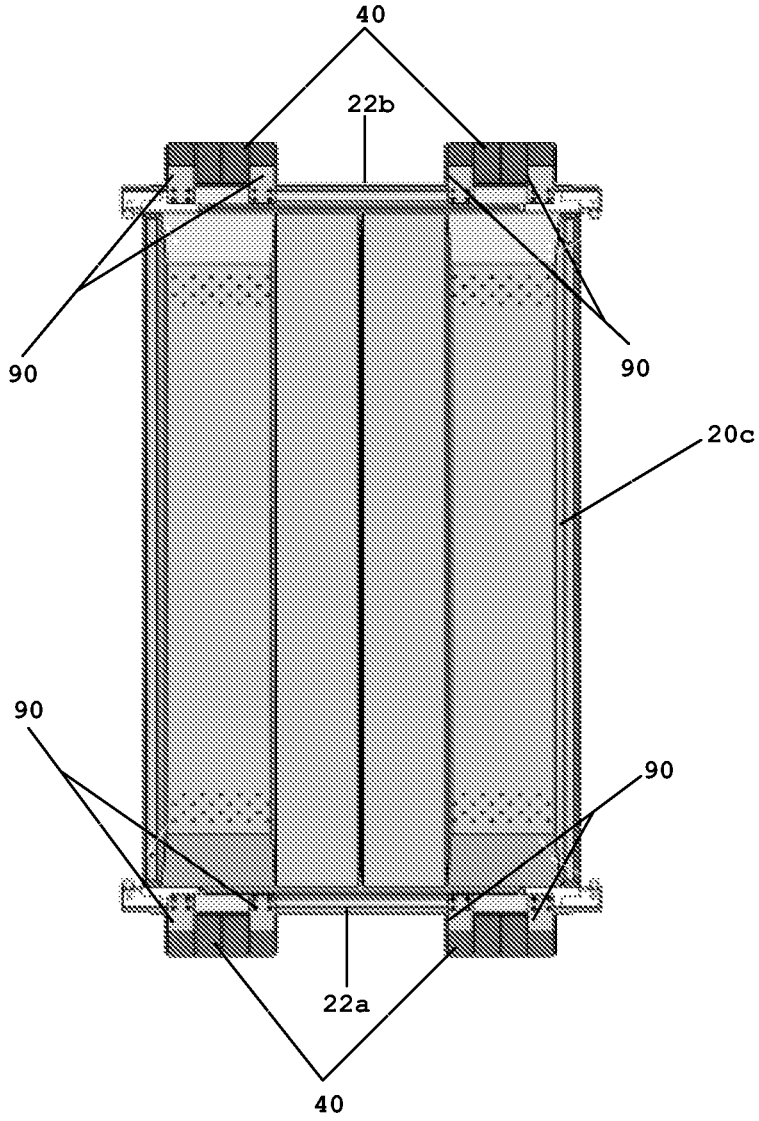
FIG. 3*d* shows a bottom plan view of a parking platform with two drive-on ramps connected to each end.
Figure 3E:
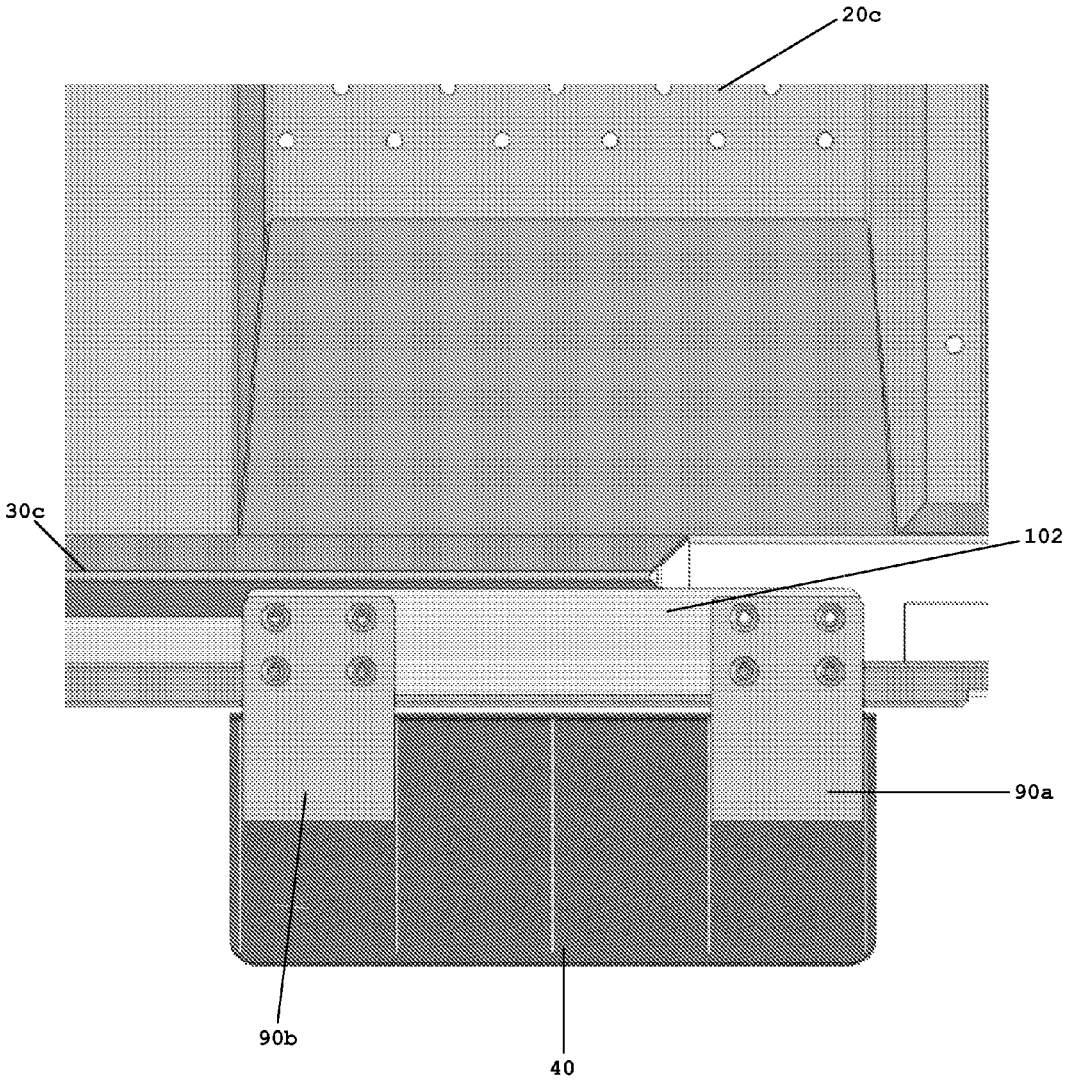
FIG. 3*e* shows a detailed bottom view of a drive-on ramp when connected to a parking platform.

Now referring to FIGS. 3*a*-3*e* the drive-on ramp 40 may comprise attachment means 90 for permanent or detachable connection with a portion of a platform 20*c*. For example, attachment means 90 may be a flange, hook, opening, bolt or other suitable device for engaging a complementary attachment device at the entrance end 22 of the lower-most platform 20*c*. As shown attachment means 90 may facilitate connection to the angled cross section member 30*c*. The drive-on ramp 40 can be permanently attached, for example, welded or hingedly fixed to an angled cross section member 30*c* of the lower-most parking platform 20*c* so that it rises along with the platform 20*c*. In one example, the drive-on ramp 40 may be attached via bolts connected to corresponding openings formed in one or more of the drive-on ramp 40 or the angled cross section member 30*c* of the platforms. In the embodiment of FIGS. 3*c*-3*e*, the attachment means is a flange 90 connected to the bottom surface 60 of the drive-on ramp 40 with apertures 100 thereon which facilitate connection of the flange 90 to the angled cross section member 30*c*. In one embodiment as shown in FIG. 3*e*, a drive-on ramp 40 includes flanges 90*a* and 90*b* mounted to a plate 102 extending from the bottom of angled cross-section member 30*c*. Additionally, as will be apparent to those skilled in the art, it may be appreciated that the attachment means 90 can be located at or extend from any portion of the drive-on ramp 40, for example, surface 80, or its bottom surface 60 etc. as in FIG. 3*d*. Although the ramp 40 is shown to have a regular triangular cross section, it can have other shapes for example, the triangular cross sectional profile may have an upper edge that is slightly rounded. As will be apparent to the skilled artisan the ramp is preferably made of materials strong enough to support vehicles being driven thereon, such as but not limited to metal, wood, and composite materials. Non-corrosive material is preferred.

The drive-on ramp 40, in conjunction with the angled cross section members 30*a*-30*c* facilitates smooth movement of the vehicles across the parking platforms 20*a*-20*c*, overcoming the problems of the prior art. The ramp 40 disposed at the entrance end 22 of the lowest platform 20*c* is operable with each of the angled sections 30*a*, 30*b* and 30*c* to provide a more gradual incline for vehicles to be driven on and off the three platforms. In an embodiment wherein the ramp 40 is attached at the entrance end 22 of the platform, the ramp 40 can be raised off the ground level 16 whenever the lower-most platform 20*c* is raised. This allows the ground level 16 to be clear of obstructions whenever all the platforms 20*a*-20*c* are in the raised position.

There may be provided only a very small height difference between the nested angled cross section members 30*a*, 30*b* and 30*c* and the top-most portion of drive-on ramp 40, thus allowing a smaller obstruction for the vehicle to be driven over. Since no fixed ramp is required at the ends of the upper platforms 20*a* and 20*b*, these platforms can be made lighter and are more cost effective.

In one embodiment, the angled cross section members 30*a*, 30*b*, and 30*c* may have angles formed between the sections 32, 34, 36 and 38 so that the gap between the top end of drive-on ramp 40 and angled cross section members 30*a*, 30*b* and 30*c* is very small. A skilled artisan will appreciate that the improved drive-on ramp system can be optimized for vehicles having smaller wheels (and therefore less clearance with ramps or platforms) or differing numbers of platforms (and the resultant height difference) by adjusting the angle that angled cross section members 30*a*, 30*b* and 30*c* make with the horizontal. Another advantage of the present invention is that because the drive-on ramp 40 and the angled cross section members 30*a*, 30*b* and 30*c* can be designed to accommodate different heights, the platforms can be shorter and only one drive-on ramp 40 is needed for any one system.

In practice, a lift mechanism raises platform 20*a* when loaded with a vehicle to a first height. In this position, a second vehicle is loaded onto the platform 20*b*, which is then raised to a second height, and so on for platform 20*c*, so that a fourth vehicle may be parked at the ground level 16. In this case, it may be noted that when the platform 20*c* is raised, the drive-on ramp 40 attached thereto is also raised with it so that the vehicle parked at the ground level 16 may be driven smoothly into the spot. It can also be appreciated that while the figures show the drive-on ramp 40 attached to one side of the lower-most platform 20*c*, this is not necessary. Referring to FIG. 3*d*, in one embodiment lower-most platform 20*c* may include sides 22*a* and 22*b*, and a second drive-on ramp 40 can be attached to opposite entrance sides 22*a* and 22*b* of the platform 20*c* to facilitate movement of vehicles from either side of the multilevel parking system 10.

When it is desired to remove the vehicles, the vehicle parked at the ground level is moved out first. Platform 20*c* is lowered to the ground level 16 and the vehicle on the platform 20*c* can exit the platform. At this position, the drive-on ramp 40 is located at the ground level 16 so that it supports the vehicle on the platform 20*c* as it is moved off the platform 20*c*. Successive platforms are lowered until the vehicles on platforms 20*b* and subsequently 20*a* are similarly removed. During this operation, the drive-on ramp 40 supports the vehicles as they are removed from platforms 20*b*, 20*a*. Thus, the drive-on ramp 40 attached to the platform 20*c* mitigates the need for duplicate ramps on upper platforms thereby facilitating installation of shorter and more lightweight platforms on the multilevel parking system 10.

Figure 5:
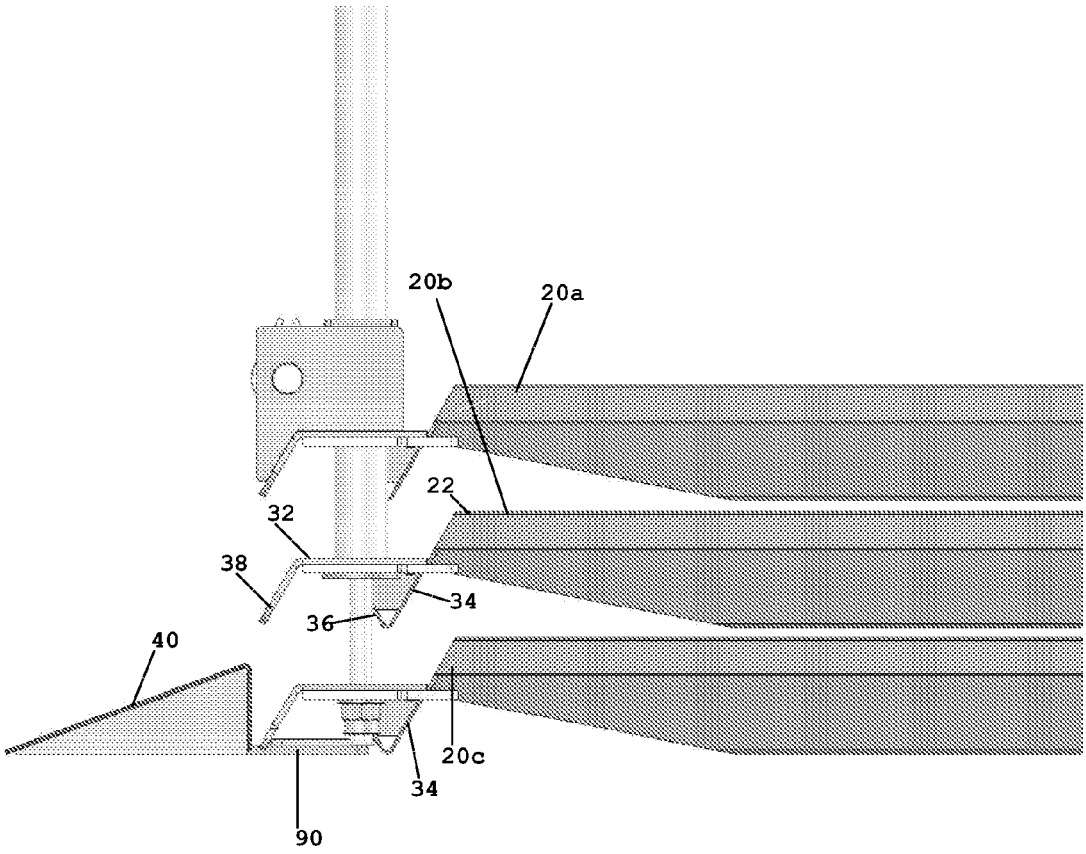
FIG. 5 depicts an illustration showing a side view of the angled cross section members of the platforms in the partially nested configuration in accordance with one aspect of the present invention.

FIG. 5 shows platforms 20*a*, 20*b* and 20*c* as they are being raised. As seen in FIG. 5, the drive-on ramp 40 is attached to the lower-most platform 20*c* thereby facilitating vehicles to be driven on and off the platforms easily. The drive-on ramp 40 not only makes the platforms shorter and easier to handle and ship but also allows the ramps to be attached to both ends of a platform when the vehicles are required to drive across it for entrance at one end and exit at the other, or to only one end of the platform when not so required.

While the preceding describes a common vertical lift system that lifts a platform, or series of platforms, from the four corners of the platforms, this invention is advantageous in that it is adaptable to any system that uses any quantity of vertical support members such as a cantilever system that uses only two vertical supports. Although the systems and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

All references cited herein are incorporated by reference in their entirety.

What is claimed is:

1. A multilevel parking system operable to be positioned on a base surface comprising:

at least two vertically movable parking platforms stacked vertically one above the other to accommodate vehicles, each parking platform comprising an entrance end and opposing sides oriented perpendicular to the entrance end, each parking platform comprising an angled cross section member positioned across at least a portion of a width of the entrance end of each parking platform, the angled cross section member comprising a planar member having a length extending transverse the parking platform and parallel the entrance end of each of the at least two platforms and a width extending perpendicular to the length, the planar member comprising a downwardly angled portion and an upwardly angled portion, the downwardly angled portion and upwardly angled portion forming a structure having a V-shaped cross-section extending transverse to the parking platform parallel to the entrance end with the bottom of the V to extending in a downward direction toward the base surface, and a lip extending in a downward direction from the planar member across a width of the entrance end and having a leading edge facing the entrance end, wherein the angled cross section members are operable to nest against each other when the at least two platforms are brought into close proximity; and at least one drive-on ramp, oriented proximal the entrance end of at least a lower-most parking platform when the lower-most parking platform is in a fully lowered position.

2. The multilevel parking system of claim 1, wherein one or more of the drive-on ramp or the angled cross section members comprises means for detachably fixing the drive-on ramp at the entrance end of the platform.

3. The multilevel parking system of claim 1, wherein the drive-on ramp is permanently attached to an entrance end of the lower-most platform.

4. The multilevel parking system of claim 1, comprising more than one drive-on ramp attached to the entrance end of the lower-most platform.

5. The multilevel parking system of claim 1, further comprising a frame supporting the at least two parking platforms.

6. The multilevel parking system of claim 1 wherein the planar member comprises an aperture formed therein and wherein the downwardly angled portion extends from an edge of the aperture parallel the entrance end and the upwardly angled portion extends from a leading edge of the downwardly angled portion to an opposite edge of the aperture.

7. A multilevel parking system operable to be positioned on a base surface comprising:

at least two means for supporting vehicles thereon arranged vertically one above another, each means for supporting comprising at least one entrance end comprising an inclined edge to facilitate entrance and exit of vehicles from the means for supporting and opposing sides oriented perpendicular to the entrance end, each parking platform, each entrance end comprising an angled cross section member positioned across at least a portion of a width of the entrance end of each means for supporting, the angled cross section member comprising a planar member having a length extending transverse to the means for supporting and parallel the entrance end of each of the at least two means for supporting and a width extending perpendicular to the length, the planar member comprising a downwardly angled portion and an upwardly angled portion, the downwardly angled portion and upwardly angled portion forming a structure having a V-shaped cross-section extending transverse the means for supporting parallel to the entrance end with the bottom of the V extending in a downward direction toward the base surface, and a lip extending downward from the planar member across a width of the entrance end and having a leading edge facing the entrance end; and means for reducing an angle of the inclined edge to provide a gradual inclination for the entrance of the vehicles, the means for reducing disposed proximate to the inclined edge of a lower-most supporting means.

8. The multilevel parking system of claim 7, wherein the at least two supporting means are adaptable to be nested when disposed in a fully lowered position.

9. The multilevel parking system of claim 7 wherein the planar member comprises an aperture formed therein and wherein the downwardly angled portion extends from an edge of the aperture parallel the entrance end and the upwardly angled portion extends from a leading edge of the downwardly angled portion to an opposite edge of the aperture.

* * * * *

UNITED STATES PATENT AND TRADEMARK OFFICE

CERTIFICATE OF CORRECTION

PATENT NO. : 8,414,243 B2
APPLICATION NO. : 12/765026
DATED : April 9, 2013
INVENTOR(S) : Van Stokes It is certified that error appears in the above-identified patent and that said Letters Patent is hereby corrected as shown below:

In the Claims:

Claim 1, Column 7, line 9, after the phrase "bottom of the V" delete the word "to"

Signed and Sealed this
Fourth Day of June, 2013

Teresa Stanek Rea
*Acting Director of the United States Patent and Trademark Office*